US006827058B1

(12) United States Patent
Falero

(10) Patent No.: US 6,827,058 B1
(45) Date of Patent: Dec. 7, 2004

(54) INTERNAL COMBUSTION ENGINE HAVING CO-AXIAL PISTONS ON A CENTRAL YOKE

(76) Inventor: Avelino Falero, P.O. Box 2590, Juncos, PR (US) 00777

( * ) Notice: Subject to any disclaimer, the term of this patent is extended or adjusted under 35 U.S.C. 154(b) by 0 days.

(21) Appl. No.: 10/640,277

(22) Filed: Aug. 14, 2003

(51) Int. Cl.[7] ..... F02B 75/32
(52) U.S. Cl. ..... 123/197.4; 123/198 R
(58) Field of Search ..... 123/197.4, 90.21

(56) References Cited

U.S. PATENT DOCUMENTS 928,715 A * 7/1909 Thurber ..... 123/90.21
1,687,744 A 10/1928 Webb
2,122,676 A 7/1938 Bourke
2,172,670 A 9/1939 Bourke
4,312,306 A 1/1982 Bundrick, Jr.
4,395,977 A 8/1983 Pahis
4,485,768 A 12/1984 Heniges
4,608,951 A 9/1986 White
4,864,976 A 9/1989 Falero
4,893,592 A 1/1990 Falero
D308,031 S 5/1990 Falero

* cited by examiner

*Primary Examiner*—Noah P. Kamen
(74) *Attorney, Agent, or Firm*—Oliff & Berridge, PLC

(57) ABSTRACT

An internal combustion engine includes a housing having a central connecting portion and a longitudinal axis, a pair of co-axial cylinders, a crankshaft, a yoke disposed within the central connecting position, an auxiliary shaft and at least one flywheel. Each co-axial cylinder is disposed on one of opposite ends of the longitudinal axis. Each co-axial cylinder contains a piston translating therein along the longitudinal axis. The yoke connects to each piston. The yoke includes a yoke gear perambulating around the crankshaft. The flywheel is connected to the crankshaft. The flywheel has an axial cam to controllably translate the auxiliary shaft. This internal combustion engine provides for a more compact design and without the need for pulleys and belts.

18 Claims, 7 Drawing Sheets

INTERNAL COMBUSTION ENGINE HAVING CO-AXIAL PISTONS ON A CENTRAL YOKE

BACKGROUND OF THE INVENTION

1. Field of Invention

This invention relates to an internal combustion engine having co-axial pistons on a central yoke. More particularly, this invention relates to reciprocating and pivoting motion produced by cam rotations from a crankshaft.

2. Description of Related Art

Reciprocating piston internal combustion engines have been known for many years. A fundamental operating requirement common to internal combustion engines of the reciprocating piston type is that the reciprocal motion of the pistons must be translated into rotary motion of a crankshaft. This has been achieved most conventionally through a connecting rod attached to each piston at one end through a wrist pin and rotatably mounted to an offset crank arm of the crankshaft at an opposite end.

Other arrangements for converting the reciprocal motion of the piston into rotary motion of a crankshaft have also been proposed. For example, an elongated internally toothed roller gear is attached to a piston and moved to maintain engagement of the teeth with a crankshaft drive gear to impart rotation thereto. Examples of such arrangements are shown in U.S. Pat. Nos. 1,687,744, 4,608,951 and 4,395,977. Such arrangements have heretofore not achieved wide spread commercial acceptability.

Opposed-cylinder internal combustion engines are also known. In such engines, dual pistons are fixed to a common yoke structure or connecting rod arrangement and the pistons are reciprocated within opposed cylinders. Reciprocal motion of the pistons is conventionally translated into rotary motion by an offset crank pin of a crankshaft. U.S. Pat. Nos. 2,172,670 and 2,122,676 disclose engine designs wherein opposed pistons are connected by a connecting rod arrangement. U.S. Pat. No. 4,485,768 discloses a common yoke type internal combustion engine as described and further includes means for altering the stroke and compression ratio of the engine. Specifically, this is achieved by altering the orbital path of a co-axial crank pin and slider relative to a crankshaft axis.

U.S. Pat. No. 4,864,976 which discloses a dual headed piston body formed by a pair of first and second piston heads attached respectively to opposite ends of a central yoke structure. An internally toothed roller gear is mounted for rectilinear movement within the yoke structure. The roller gear engages with a crankshaft drive gear, while control and actuator means are provided for effective synchronized movement of the roller gear within the yoke structure. This arrangement maintains constant engagement of the crankshaft drive gear with the roller gear as the dual-headed piston body reciprocates within the cylinder.

SUMMARY OF THE INVENTION

An opposed-cylinder internal combustion engine, as described herein, includes housing with cylindrical chambers on opposite ends of a central connecting portion along a longitudinal cylinder axis of the housing. A manifold piston and a co-axial valve assembly translate independently along the longitudinal cylinder axis within each of the cylindrical chambers. Within the central connection portion, a yoke housing reciprocates along the cylinder axis, while a yoke gear within the yoke housing also perambulates in a transverse direction.

A crankshaft having shaft teeth and shaft cams rotates in the central connecting portion. Yoke teeth on the yoke gear engage the shaft teeth on the crankshaft. The shaft cams extend radially from the outer circumference of the crankshaft. Curved actuator arms engage the shaft cams. The actuator arms pivot on pegs connected to the yoke housing and push components of the co-axial valve assembly.

The crankshaft is connected to at least one flywheel. Flywheel cams protrude axially from the inner rim of the flywheel facing towards the yoke housing. The flywheel cams engage one or more auxiliary shafts to operate a pump or other components in the engine.

In various exemplary embodiments of the devices according to this invention, a compact engine design can be realized.

In various exemplary embodiments, this invention provides a system of flywheel cams, crankshaft cams, rocker arms, a central yoke, co-axial valves and pistons to operate an engine having opposed cylinders.

In various exemplary embodiments, this invention eliminates the need for chain or belt pulleys and other devices for transferring power from the rotating crankshaft.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the methods of this invention will be described in detail with reference to the following figures, wherein.

DETAILED DESCRIPTION OF EXEMPLARY EMBODIMENTS

Figure 1:
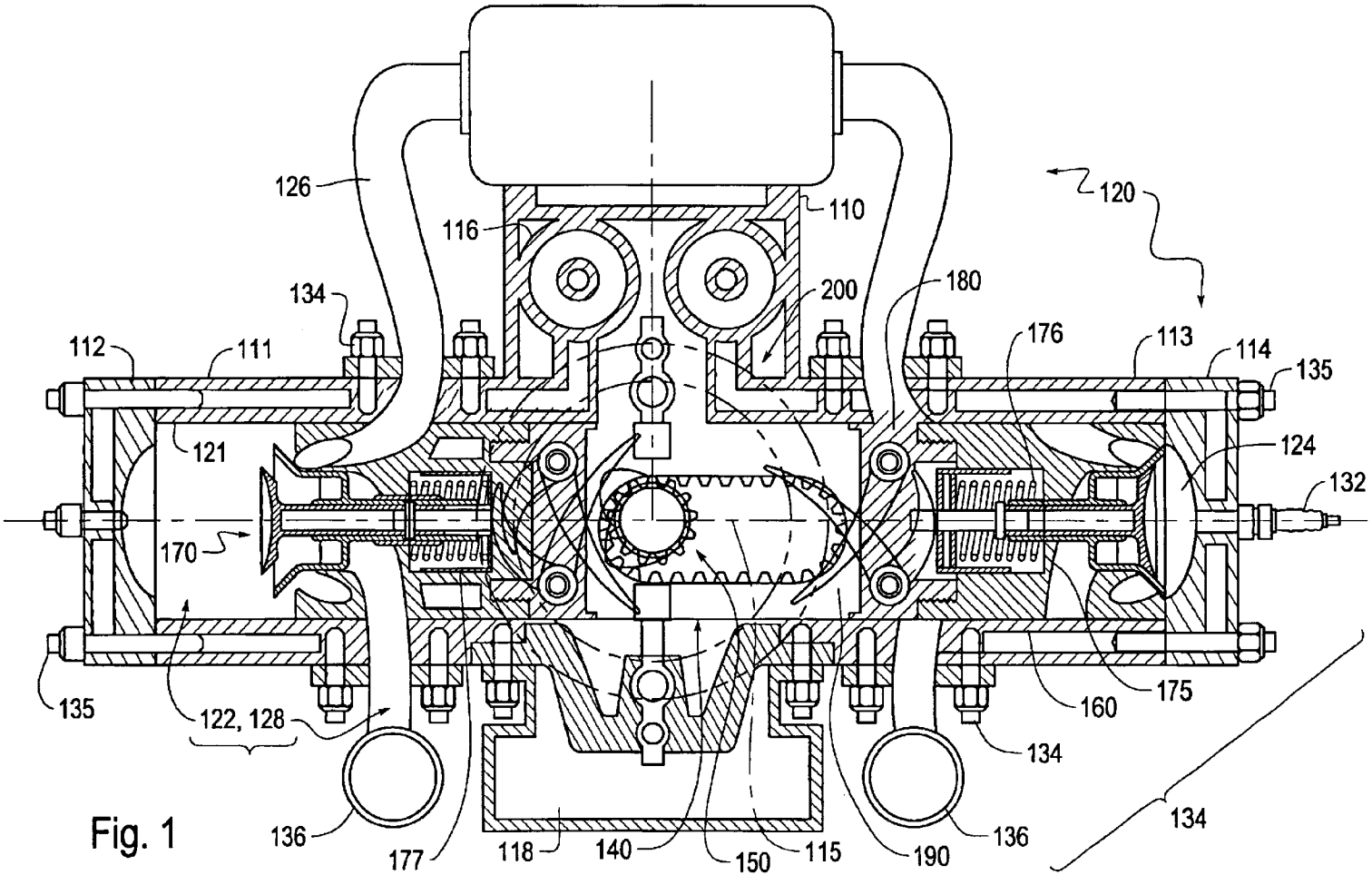
FIG. 1 is an elevation view for an exemplary embodiment of an opposed-cylinder internal combustion engine according to this invention.

These principles can be depicted by the accompanying drawings. FIG. 1 illustrates generally an opposed-cylinder engine 100, in elevation view, having an opposed-cylinder dual-headed engine housing 110 of the present invention. The engine housing 110 is flanked by a left cylinder 111 with a left cap 112 and by a right cylinder 113 with a right cap 114. The cylinders 111 and 113 commonly share a longitudinal cylinder axis 115. The engine housing 110 also includes a pump 116 and an oil reservoir 118. Within the engine housing 110 are housing cavities 120 along the cylinder axis 115. A cylinder bore 121 bounds a region along the cylinder axis 115 for the cylinders 111 and 113.

In the configuration shown in FIG. 1, an expansion cavity 122 is positioned for the left cylinder 111 and a compression cavity 124 is correspondingly provided for the right cylinder 113. The housing cavities 120 also include an intake channel 126 and an exhaust channel 128. The engine housing 110 also includes accoutrements 130 such as sparkplugs 132, yoke attach bolts 133 (shown in FIG. 4), circumferential bolts 134, axial bolts 135, exhaust ports 136, and an intake manifold 138.

The engine 100 further includes a yoke assembly 140 in the central connecting portion, a crankshaft assembly 150, a pair of pistons 160, and a pair of valve assemblies 170. Cooperation between these components is provided through four rocker pegs 180 on which eight rocker arms 190 pivot. A flywheel assembly 200 cooperates with the crankshaft assembly 150 to controllably engage auxiliary shafts of the auxiliary shaft set 220, enabling other systems associated with the engine 100 to operate concurrently with the turning of the crankshaft assembly 150.

Figure 2:
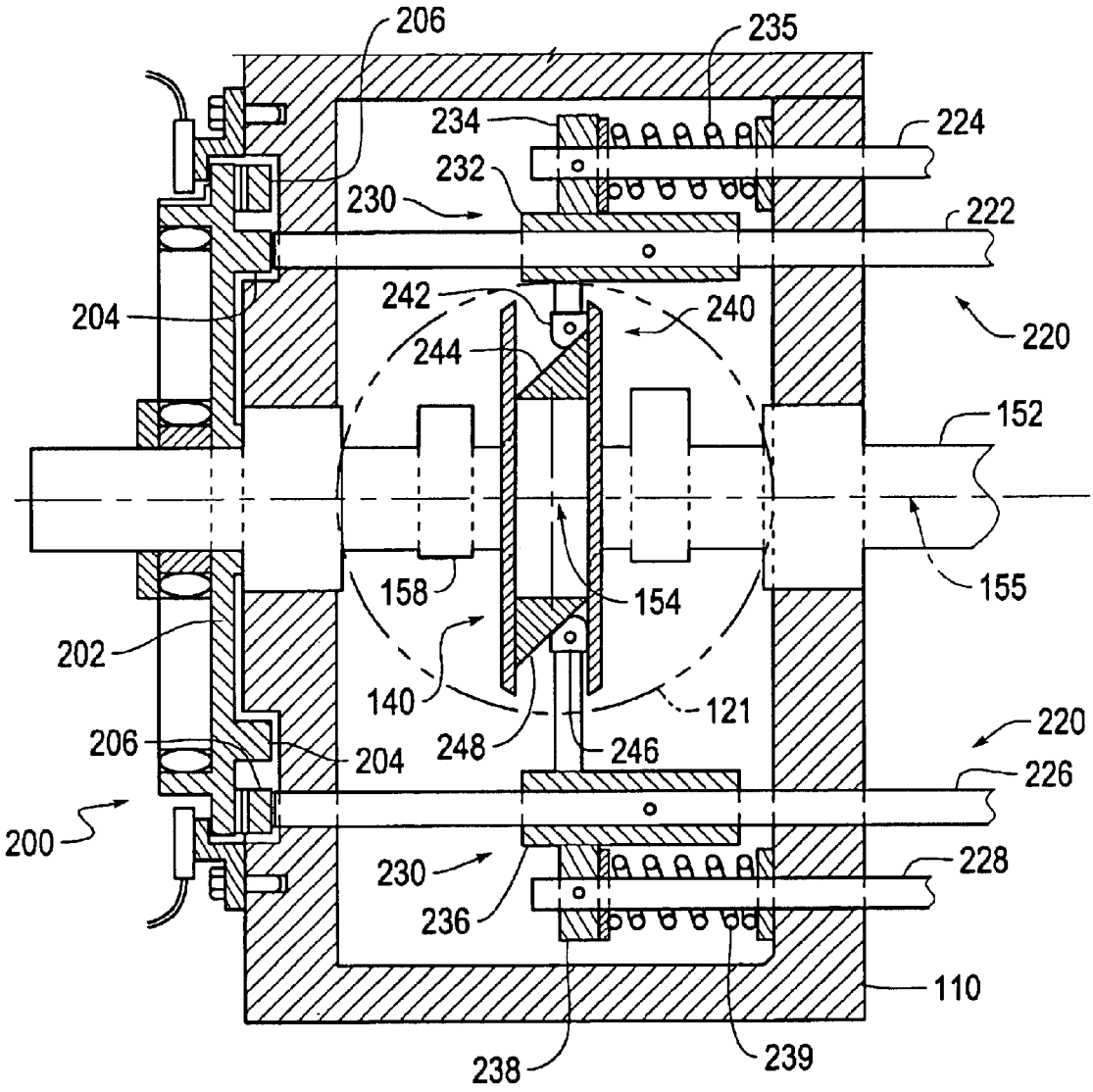
FIG. 2 is a profile view for an exemplary embodiment of an opposed-cylinder internal combustion engine according to this invention.
Figure 10:
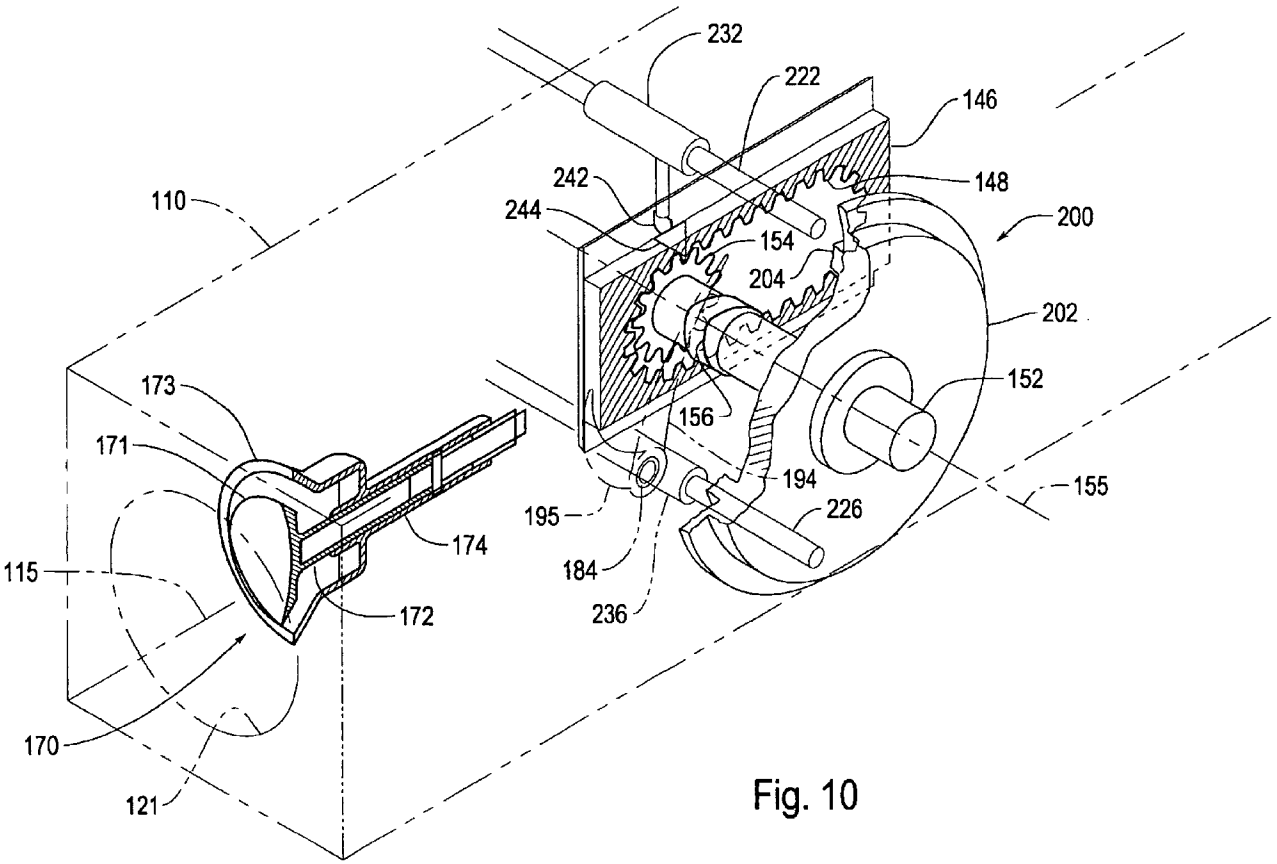
FIG. 10 is an isometric view for the exemplary embodiment shown in FIG. 2 of portions of an opposed-cylinder internal combustion engine according to this invention.

FIG. 2 shows a profile view of an exemplary embodiment, e.g., a single-flywheel embodiment, for this invention. The crankshaft assembly 150 includes a crankshaft 152 having shaft teeth 154, a reverse radial cam 156 and an obverse radial cam 158. The crankshaft 152 rotates about to a crankshaft axis 155. The crankshaft axis 155 is disposed perpendicular to the cylinder axis 115 of the housing 110. The shaft teeth 154 outwardly circumscribe the crankshaft 152 along a portion of its length. The flywheel assembly 200 includes a flywheel 202 attached to the crankshaft 152. FIG. 10 shows an isometric view of this exemplary embodiment.

The flywheel 202 includes an inner axial cam 204 and an outer axial cam 206, both extending towards the auxiliary shaft set 220. The axial cams 204 and 206 may extend in a continuous ring, or be arcuately segmented. The auxiliary shafts of the auxiliary shaft set 220 can be connected together by sleeve assemblies 230. The sleeve assemblies 230 are connected to roller assemblies 240, which in turn are connected to the yoke assembly 140.

Figure 9:
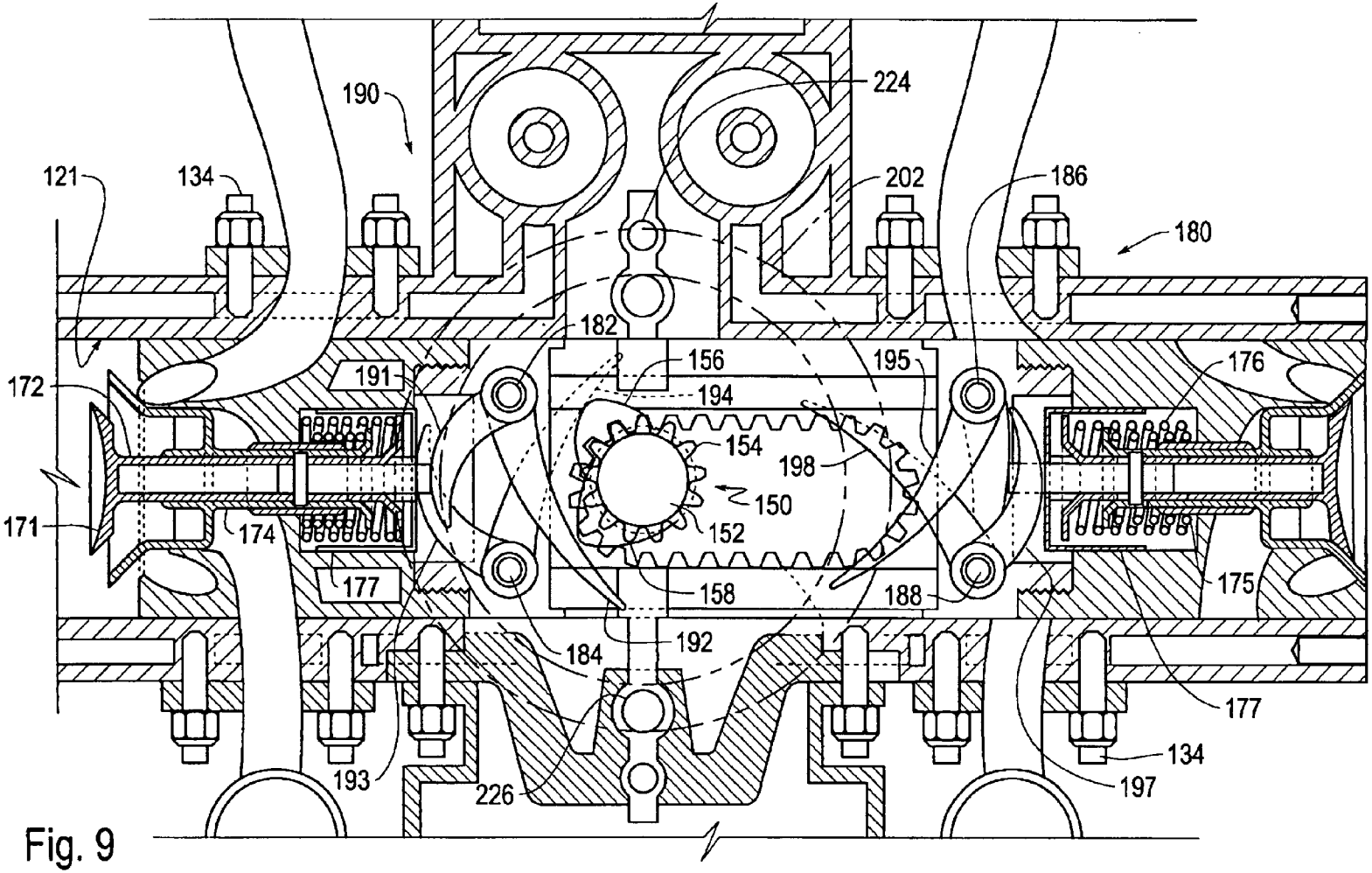
FIG. 9 is an elevation view for an exemplary embodiment of a yoke gear assembly with a crankshaft assembly according to this invention.

The auxiliary shaft set 220 includes an upper inner auxiliary shaft 222, an upper outer auxiliary shaft 224, a lower inner auxiliary shaft 226 and a lower outer auxiliary shaft 228. In the configuration shown, the outer axial cam 206 engages the lower inner auxiliary shaft 226 (as also shown in FIG. 9). Additionally, the inner axial cam 204 engages the upper inner auxiliary shaft 222. In the embodiment shown, the auxiliary shafts 222, 224, 226 and 228 are parallel to the crankshaft axis 155.

The inner auxiliary shafts 222 and 226 are connected to the outer auxiliary shafts 224 and 228, respectively, by the shaft sleeve assemblies 230. An upper inner sleeve 232 is fixedly attached to the upper inner auxiliary shaft 222. An upper outer sleeve 234 is fixedly attached to the upper outer auxiliary shaft 224. The upper inner sleeve 232 and the upper outer sleeve 234 are fixedly connected together. Similarly, a lower inner sleeve 236 and a lower outer sleeve 238 are fixedly attached to respective lower auxiliary shafts 226 and 228, and the lower sleeves 236 and 238 are fixedly connected together.

The inner axial cam 204 pushes the upper inner auxiliary shaft 222 away from the flywheel 202 along a direction parallel to the crankshaft axis 155. Because the upper sleeves 232 and 234 are fixedly joined together, the motion of the upper inner auxiliary shaft 222 is accompanied by complimentary motion of the upper outer shaft 224. This force against the upper outer auxiliary shaft 224 is partially counteracted by an upper outer spring 235 disposed between the upper outer sleeve 234 and the housing 110.

Similarly, the outer axial cam 206 pushes the lower inner auxiliary shaft 226 away from the flywheel 202, together with the lower outer shaft 228 through the lower sleeves 236 and 238. This force applied to move against the lower outer auxiliary shaft 228 is partially counteracted by a lower outer spring 239 between the lower outer sleeve 238 and the housing 110.

Through the cylinder bore 121, the roller assemblies 240 are shown cooperating with the sleeve assemblies 230. An upper roller 242 is connected to the upper inner sleeve 232. The upper roller 242 moves radially and axially along an upper slider 244. Similarly, a lower roller 246 is connected to the lower inner sleeve 236. The lower roller 246 moves radially and axially along a lower slider 248. As the crankshaft assembly 150 rotates, the yoke assembly 140 moves (or perambulates) about the crankshaft 152.

As the upper inner auxiliary shaft 222 shifts axially along the direction of the crankshaft axis 155, the yoke assembly 140 moves around the crankshaft 152. This interaction is shown in FIGS. 2 and 10. Coincidentally, the upper roller 242 slides along the upper slider 244. Consequently, the upper roller 242 moves radially inward and outward while also moving along the direction of the crankshaft axis 155. The upper roller 242 is fixedly connected to the auxiliary shaft 222, which shifts axially along the direction of the crankshaft axis 155 being pushed back and forth by the inner axial cam 204 of the flywheel 202. Similarly, the lower inner auxiliary shaft 226 shifts axially along the direction of the crankshaft axis 155 as the lower roller 246 slides along lower slider 248.

Figure 3:
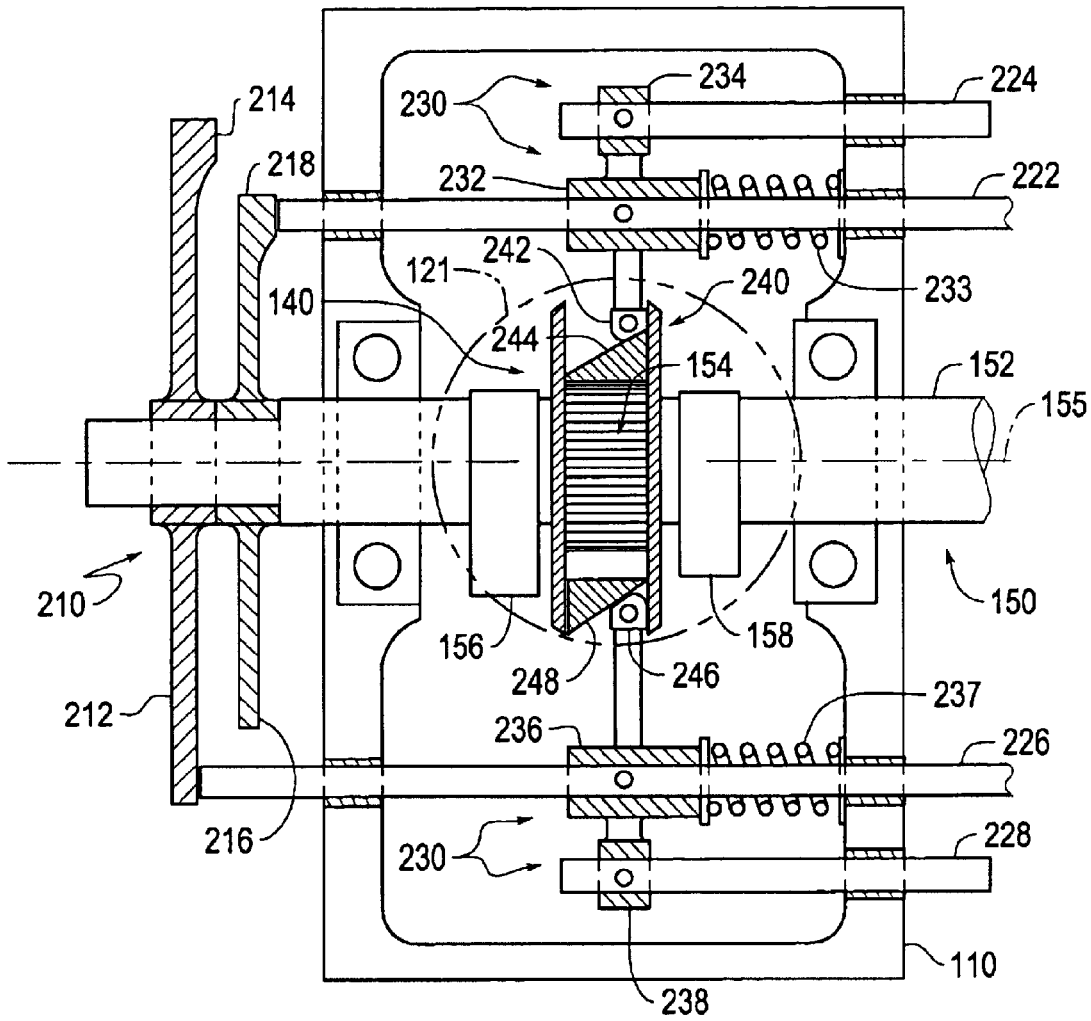
FIG. 3 is a profile view for another exemplary embodiment of an opposed-cylinder internal combustion engine according to this invention.

FIG. 3 shows a profile view of another exemplary embodiment, e.g., a dual-flywheel embodiment, for this invention. The duo-flywheel assembly 210 includes an outer flywheel 212 having an outer axial cam 214, and an inner flywheel 216 having an inner axial cam 218. Both outer and inner flywheels 212 and 216 are attached to the crankshaft 152. The axial cams 214 and 218 can either extend as a continuous ring or else be arcuately segmented.

In the configuration shown, the inner axial cam 218 on the inner flywheel 216 pushes the upper inner auxiliary shaft 222 along the crankshaft axis 155 away from the inner flywheel 216. This force, by the connection with the upper inner sleeve 232 to the upper outer sleeve 234, also pushes the upper outer shaft 224. This force against the upper outer auxiliary shaft 224 is partially counteracted by an upper inner spring 233 disposed between the upper inner sleeve 232 and the housing 110.

Additionally, the outer flywheel 212 (absent the outer axial cam 214) engages the lower inner auxiliary shaft 226. Any similar force against the lower inner auxiliary shaft 228 is partially counteracted by a lower inner spring 237 between the lower inner sleeve 236 and the housing 110. Otherwise, the operation is similar to the single-flywheel embodiment described for FIG. 2.

Figure 4:
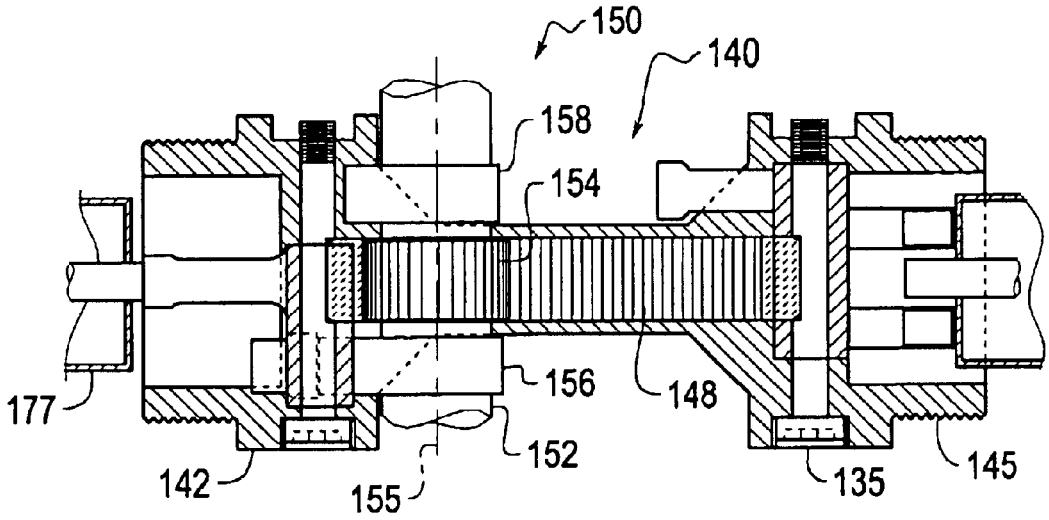
FIG. 4 is a plan view for an exemplary embodiment of a yoke housing and a crankshaft assembly according to this invention.
Figure 5:
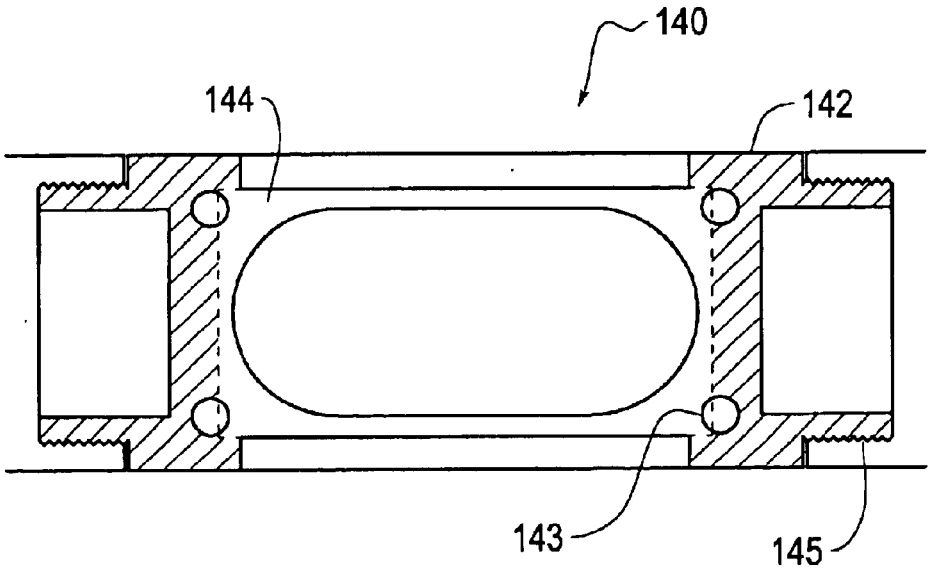
FIG. 5 is an elevation view for an exemplary embodiment of a yoke housing according to this invention.

FIG. 4 illustrates a plan view of the yoke assembly 140 and the crankshaft assembly 150. The yoke assembly includes a yoke housing 142 held to the engine housing by attach bolts 135. FIG. 5 provides an elevation view of the yoke housing 142 including four bolt holes 143 through which the attach bolts 135 are inserted, a yoke gear cavity 144, and male screw threads 145 for attaching the piston 160. The yoke gear 146 includes yoke teeth 148 inwardly circumscribing the path to engage the shaft teeth 154 of the crankshaft assembly 150. A variety of closed geometric shapes having a continuous derivative can form the interior path.

Figure 6:
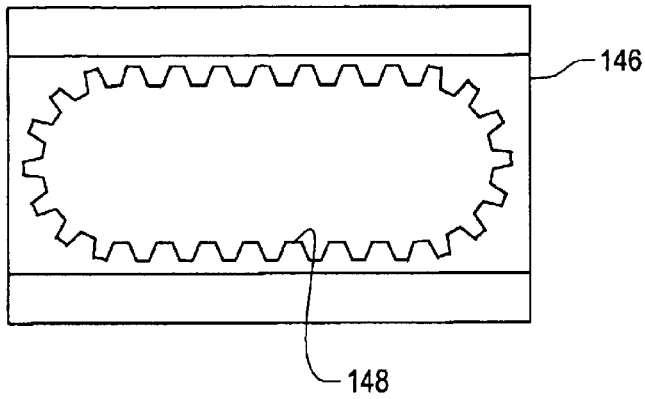
FIG. 6 is an elevation view for an exemplary embodiment of a yoke gear according to this invention.

FIG. 6 shows an elevation view of a yoke gear 146 having an elongated oval having a semicircle at either end. The yoke teeth 148 engage the shaft teeth 154 (as shown in FIG. 9) to move the yoke gear 146 around the crankshaft 152. The motion of the yoke gear 146 includes translating along two orthogonal directions. The direction having a greater extent of motion translates the yoke gear 146 longitudinally along the cylinder axis 115. The direction having a lesser extent of motion translates the yoke gear 146 transversely either towards the auxiliary shafts 222 and 224 or else towards the lower auxiliary shafts 226 and 228. The yoke housing 142 converts the perambulatory motion of the yoke gear 146 within the yoke cavity 144 into reciprocating translation along the cylinder axis 115 towards either the left cylinder 111 or else the right cylinder 113.

Figure 7:
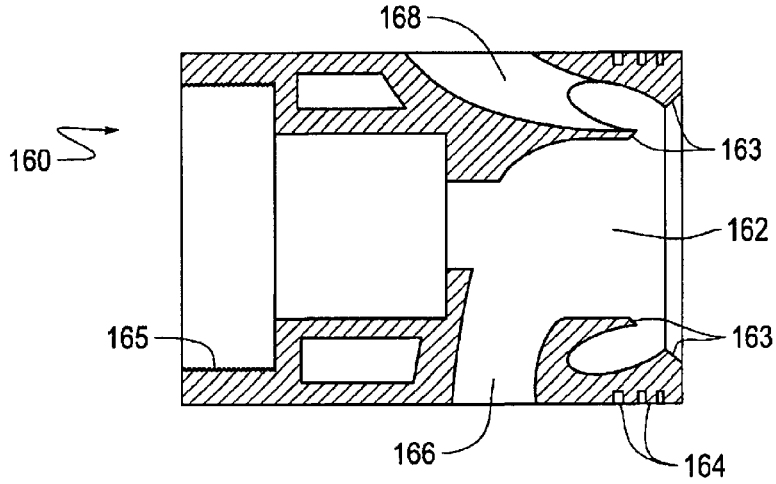
FIG. 7 is an elevation view for an exemplary embodiment of a piston according to this invention.

FIG. 7 shows an elevation view of the piston 160 with several chambers and surfaces. The piston 160 includes a valve cavity 162 terminating in valve seats 163. The piston 160 also includes o-ring cavities 164 for sealing regions separated by walls of the cylinder bore 121. The piston 160 connects to the male screw threads 145 of the yoke housing 142 by female screw threads 165, so that when the yoke assembly 140 translates along the cylinder axis 115, the pistons 160 follow in concert. The piston 160 also includes an intake chamber 166 and an exhaust chamber 168.

Figure 8:
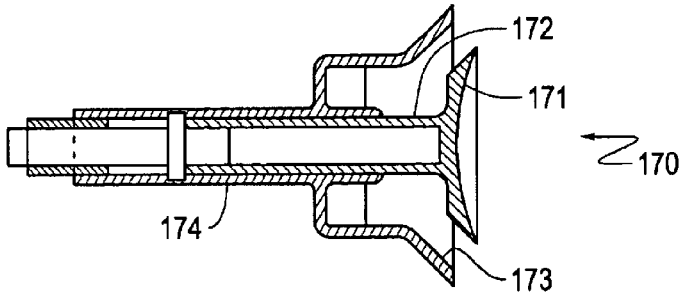
FIG. 8 is an elevation view for an exemplary embodiment of a co-axial valve according to this invention.

FIG. 8 shows an elevation view of part of the co-axial valve assembly 170 operating within the cylinder cavity 162. The co-axial valve assembly 170 includes an inner valve head 171 connected to an inner valve stem 172, and an outer valve head 173 connected to an outer valve stem 174. Additionally, as shown in FIG. 9, inner valve stem 172 is restrained by an inner spring 175 against an inner stop, and outer valve stem 174 is restrained by an outer spring 176 against an outer stop, both stops connected to a spring cup 177.

The elevation view of the yoke assembly 140 and the crankshaft assembly 150 in FIG. 9 also illustrates the rocker pivots or pegs 180 and the rocker arms 190 from FIG. 1 in greater detail. The rocker pegs 180 include the upper left peg 182, the lower left peg 184, the upper right peg 186 and the lower right peg 188. The positions of these rocker pegs 180 correspond to the bolt holes 143 of the yoke housing 142. The axes of the rocker pegs 180 are parallel to the crankshaft axis 155.

The rocker arms 190 for the left cylinder 111 include the upper left valve arm 191, the upper left cam arm 192, the lower left valve arm 193, the lower left cam arm 194. The upper left arms 191 and 192 rotate on the upper left peg 182. The lower left arms 193 and 194 rotate on the lower left peg 184. The rocker arms 190 for the right cylinder 113 include the upper right valve arm 195, the upper right cam arm 196, the lower right valve arm 197, the lower right cam arm 198. The upper right arms 195 and 196 rotate on the upper right peg 186. The lower right arms 197 and 198 rotate on the lower right peg 188.

As the shaft assembly 150 turns, the obverse radial cam 158 pushes the upper left cam arm 192 to turn clockwise around upper left peg 182. The motion of the upper left cam arm 192 turns upper left valve arm 191 clockwise to push the inner valve stem 172 leftwards. Concurrently, the reverse radial cam 156 pushes the lower left cam arm 194 counterclockwise around lower left peg 184. The motion of the lower left cam arm 194 turns lower left valve arm 193 counterclockwise to push the spring cup 177 leftwards.

Also while the shaft assembly 150 turns, the reverse radial cam 156 pushes the lower left cam arm 194 to turn counterclockwise around lower left peg 184. The motion of lower left cam arm 194 turns lower left valve arm 193 counterclockwise to push the inner valve stem 172 leftwards. As the spring cup 177 is pushed, the springs 175 and 176 are compressed, moving the valve stems 172 and 174 leftward. This motion pushes the inner and outer valves 171 and 173 towards their closed positions.

The shaft assembly 150 simultaneously translates the yoke housing 142, so that the translation of the piston 160 cooperates with the translation of the inner and outer valve heads 171 and 173, while the left cylinder 111 provides an expansion cavity 122. These positions are reversed as the yoke assembly 140 shifts leftward so that the radial cams 156 and 158 engage the right cam arms 196 and 198 and thereby operate in conjunction with the right valve arms 195 and 197.

Similarly, FIG. 9 shows the upper right valve arm 195 and the upper right cam arm 196 in rest positions, while the right cylinder 113 provides a compression cavity 124. The lower right valve arm 197 presses against the spring cup 177 for the right cylinder 113, and limits the clockwise rotation of the lower right cam arm 198. FIG. 10 shows the interaction of the lower left cam arm 194 rotating counterclockwise around the lower left peg 184 by the reverse radial cam 156. The lower left valve arm 193, moving in conjunction with the lower left cam 194, pushes against the inner valve stem 172 through a linkage, not shown.

In particular, FIG. 10 shows an isometric view of selected interacting components in the opposed-cylinder engine 100. The assemblies shown include the housing 110, the valve assembly 170 and the flywheel assembly 200. The components shown include the cylinder bore 121, the yoke gear 146 with yoke teeth 148, the crankshaft 152, shaft teeth 154, crankshaft axis 155, reverse radial cam 156. The valve assembly 170 includes valve heads 171 and 173, valve stems 173 and 174.

The flywheel assembly 200 includes the flywheel 202 and the inner axial cam 204. Additional components shown include the lower left peg 184, the lower left valve arm 193 and the lower left cam arm 194, the inner auxiliary shafts 222 and 226, and their sleeves 232 and 236. The interactions of these components are explained above.

By providing an arrangement of flywheel cams, crankshaft cams, auxiliary shafts and pivoting arms, a more compact engine design can be realized. Further, such a design further eliminates the need for endless belt to connect pulleys and other devices for transferring power from the rotating crankshaft. The use of cams and rocker arms provide a more robust means of transmitting torque to auxiliary components of an engine than generally available through chains or belts.

While this invention has been described in conjunction with exemplary embodiments outlined above, many alternatives, modifications and variations will be apparent to those skilled in the art. Accordingly, the exemplary embodiments of the invention, as set forth above, are intended to be illustrative, not limiting. Various changes can be made without departing from the spirit and scope of the invention.

What is claimed is:

1. An internal combustion engine, comprising:

a housing having a central connecting portion and a longitudinal axis;

a pair of co-axial cylinders, each co-axial cylinder of said pair disposed on one of opposite ends of said longitudinal axis, said each co-axial cylinder containing a piston translating therein along the longitudinal axis;

a crankshaftrotating around a crankshaft axis;

a yoke disposed within the central connecting position, said yoke connected to each said piston, said yoke having a yoke gear perambulating around said crankshaft;

at least one auxiliary shaft; and at least one flywheel connected to said crankshaft, said at least one flywheel having an axial cam to controllably translate said at least one auxiliary shaft.

2. The internal combustion engine according to claim 1, wherein the at least one flywheel is a single flywheel having an inner axial cam and an outer axial cam.

3. The internal combustion engine according to claim 1, wherein the at least one flywheel is a first flywheel having an inner axial cam and a second flywheel having an outer axial cam.

4. The internal combustion engine according to claim 1, wherein said at least one auxiliary shaft is parallel to said crankshaft axis.

5. The internal combustion engine according to claim 4, wherein said at least one auxiliary shaft is controllably translated along a shaft direction parallel to said crankshaft axis by said axial cam.

6. The internal combustion engine according to claim 5, further including a shaft spring resisting translation between said at least one auxiliary shaft and said housing along said shaft direction.

7. The internal combustion engine according to claim 1, wherein said crankshaft is outwardly circumscribed by shaft teeth, said yoke gear forming a closed shape with a continuous derivative inwardly circumscribed by gear teeth, said shaft teeth engaging said gear teeth engaging to perambulate said yoke gear in response to rotating said crankshaft.

8. The internal combustion engine according to claim 1, wherein said each co-axial cylinder further includes a valve disposed co-axially with said longitudinal axis.

9. The internal combustion engine according to claim 1, wherein said crankshaft further includes at least one radially extending cam.

10. The internal combustion engine according to claim 9, further including:

a rocker peg connected to said yoke, said a rocker peg rotating about an axis parallel to said crankshaft axis;

a first rocker arm pivoting about said rocker peg when engaging said at least one radially extending cam; and a second rocker arm pivoting about said rocker peg.

11. The internal combustion engine according to claim 10, wherein said each co-axial cylinder further includes a valve disposed co-axially with said longitudinal axis, said valve translating in response to said second rocker arm.

12. The internal combustion engine according to claim 1, wherein said at least auxiliary shaft further comprises:

an inner auxiliary shaft;

an outer auxiliary shaft;

a sleeve connecting said inner auxiliary shaft and said outer auxiliary shaft; and a roller connected to said sleeve, said roller sliding along said yoke gear as crankshaft moves said yoke gear.

13. The internal combustion engine according to claim 1, wherein said each piston is coupled to the yoke by screw threads.

14. The internal combustion engine according to claim 1, wherein said each piston has a piston intake chamber and a piston exhaust chamber.

15. A opposed-cylinder body for an internal combustion engine, comprising:

a housing having a central connecting portion and a longitudinal axis;

a pair of co-axial cylinders, each co-axial cylinder of said pair disposed on one of opposite ends of said longitudinal axis, said each co-axial cylinder containing a piston translating therein along the longitudinal axis;

a crankshaftrotating around a crankshaft axis;

a yoke disposed within the central connecting position, said yoke connected to each said piston, said yoke having a yoke gear perambulating around said crankshaft;

at least one auxiliary shaft; and at least one flywheel connected to said crankshaft, said at least one flywheel having an axial cam to controllably translate said at least one auxiliary shaft.

16. The opposed-cylinder body according to claim 15, wherein the at least one flywheel is a single flywheel having an inner axial cam and an outer axial cam.

17. The opposed-cylinder body according to claim 15, wherein the at least one flywheel is a first flywheel having an inner axial cam and a second flywheel having an outer axial cam.

18. A flywheel assembly for an opposed-cylinder internal combustion engine, comprising:

at least one auxiliary shaft; and at least one flywheel connected to said crankshaft, said at least one flywheel having an axial cam to controllably translate said at least one auxiliary shaft, wherein the at least one flywheel is a first flywheel having an inner axial cam and a second flywheel having an outer axial cam.

* * * * *